US005192056A

United States Patent [19]

Espinueva

[11] Patent Number: 5,192,056

[45] Date of Patent: Mar. 9, 1993

[54] FENCE CONSTRUCTION SYSTEM

[76] Inventor: Belarmino G. Espinueva, 2710 Glen Evans Ct., San Jose, Calif. 95148

[21] Appl. No.: 782,826

[22] Filed: Oct. 25, 1991

[51] Int. Cl.[5] ..... E04H 17/14

[52] U.S. Cl. ..... 256/65; 256/59; 256/DIG. 4

[58] Field of Search ..... 256/65, 59, 19, DIG. 4, 256/72, 69; 403/232.1

[56] References Cited

U.S. PATENT DOCUMENTS

| | | | |
|---|---|---|---|
| 3,454,262 | 7/1969 | Romano | 256/19 |
| 3,537,221 | 11/1970 | Helfman et al. | 403/232.1 X |
| 3,615,110 | 10/1971 | Fugate | 256/59 |
| 3,989,226 | 11/1976 | Burgess | 256/65 |
| 4,101,226 | 7/1978 | Parisien | 403/4 |
| 4,114,860 | 9/1978 | Parisien | 256/65 |
| 4,114,861 | 9/1978 | Long | 256/67 |
| 4,239,414 | 12/1980 | Williamson | 403/387 |
| 4,280,686 | 7/1981 | Wack | 256/65 |
| 4,286,772 | 9/1981 | Parisien | 256/65 |
| 4,359,851 | 11/1982 | Daniels | 256/59 X |
| 4,688,769 | 8/1987 | Smrt | 256/65 |
| 4,792,122 | 12/1988 | Smrt | 256/68 |
| 4,899,991 | 2/1990 | Brunkan | 256/69 |
| 4,923,176 | 5/1990 | Heinz | 256/65 |
| 4,944,494 | 7/1990 | Pendleton | 256/68 |
| 4,951,925 | 8/1990 | Schultz et al. | 256/65 |
| 4,986,513 | 1/1991 | Schultz et al. | 256/65 |

OTHER PUBLICATIONS

Simpson Strong-Tie NER-393, LO24 construction bracket three photographs.

*Primary Examiner*—Andrew V. Kundrat
*Attorney, Agent, or Firm*—James J. Leary

[57] ABSTRACT

A fence construction system for simple and rapid construction of a wooden fence. The system includes upper and lower metal brackets for fastening horizontal rail members to vertical fence posts. Also disclosed are quick attachment means for rapid assembly of the fence. With the system, a durable traditional style good neighbor fence may be rapidly assembled from precut or standard sized lumber.

6 Claims, 8 Drawing Sheets

FENCE CONSTRUCTION SYSTEM

This invention relates to a system for simple and rapid construction of a fence, including a system of metal brackets for assembly of a fence from precut or standard size lumber.

BACKGROUND OF THE INVENTION

Decorative or traditional style wooden fences are often used in landscaping for visual appeal, to mark boundaries, or for privacy and security. As the material and labor costs of housing construction have risen in recent years so, too, has the cost of constructing a fence. This is especially true for traditional wooden fences such as the "good neighbor" fence because of the large amount of skilled labor involved in the traditional construction. It is desirable therefore to devise a method for rapid and economical assembly of a wooden fence with a minimum of skilled labor while maintaining the sturdiness of the construction as well as the traditional visual appeal.

A good neighbor fence, the type to which this invention is directed, is a traditional style of solid board fence which is constructed to look the same from both sides. That is, there is no "good" or "bad" side. Both sides of the fence are equally attractive. Assembly brackets have been suggested for post-and-rail fences, metal fences, and chain link fences, but as far as the inventor knows this is the first approach that has been suggested to make the construction of solid board fences and especially good neighbor fences more efficient and economical.

DISCUSSION OF THE PRIOR ART

U.S. Pat. Nos. 3,989,226 to Burgess, 4,114,861 to Long, and 4,280,686 to Wack all disclose metal brackets for the assembly of wooden post-and-rail fences. U.S. Pat. Nos. 4,688,769 and 4,792,122 to Smrt and 4,899,991 to Brunkan disclose metal brackets for assembling a combined wooden and metal fence. U.S. Pat. Nos. 4,951,925 and 4,986,513 to Schultz et al. and 4,923,176 to Heinz disclose connectors for assembling metal fences. U.S. Pat. No. 4,114,860 to Parisien discloses a fence system including brackets for assembling a chain link fence which may in the alternative include fence boards or panels.

None of the foregoing patents disclose, nor are applicable to, an improved method for constructing a traditional solid board fence or a wooden good neighbor fence.

OBJECTIVES OF THE INVENTION

In keeping with the foregoing discussions, one major objective of the present invention is to provide a means for rapid and economical construction of a solid board fence. To this end it should allow for assembly of the fence from standard size or precut lumber with a minimum of on-site cutting and fitting. At the same time it should eliminate the need for time consuming assembly techniques that require a high degree of skill or specialized tools such as dado joints, mortise-and-tenon joints, or miter joints. Concurrently another major objective of the invention is to provide a rapid means of assembling a fence that enhances (or at the very least does not diminish) the structural strength and the visual appeal of the finished fence.

Secondary to these objectives it is also an objective to provide a simple and convenient means to hold the fence together temporarily until the final attachment means such as nails or screws are driven in.

DETAILED DESCRIPTION OF THE INVENTION

Figure 2:
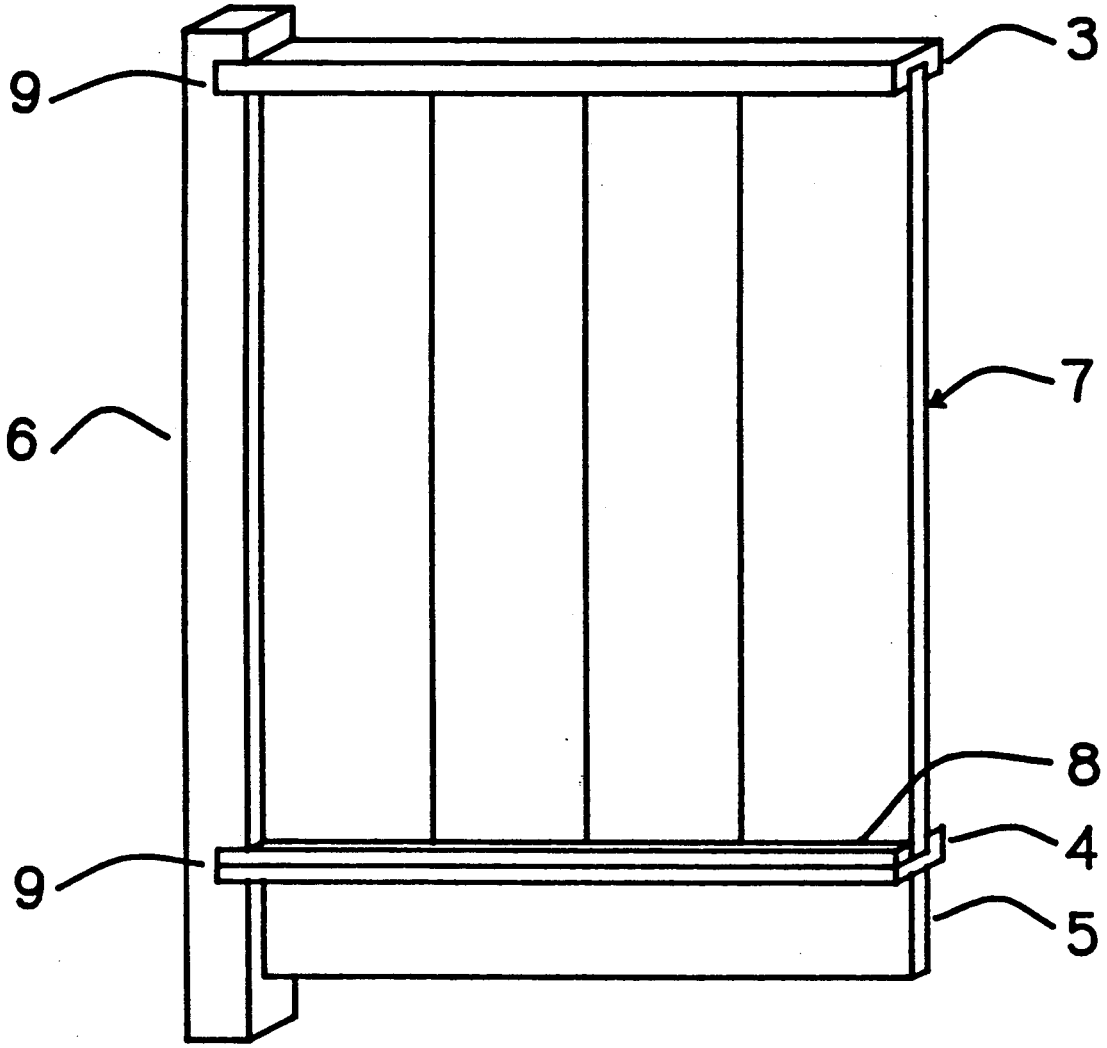
FIGURE 2 PRIOR ART
FIG. 2 shows a segment of the prior art fence built with traditional assembly methods.

Referring first to FIG. 2 which shows a segment of a good neighbor fence built in accordance with the prior art, this figure shows a fence built using traditional assembly methods. For structural strength the horizontal rails (3) and (4) are attached to the vertical post by dado joints (9). This is a complex, labor-intensive assembly process requiring special tools and a high degree of skill. To save time and expense, sometimes the dado joints are replaced with butt joints with the horizontal rails toe nailed to the vertical posts. Though this saves some time and money, it greatly compromises the structural strength of the fence because the butt joints are much weaker than dado joints. This is especially undesirable because a solid wood fence presents a lot of resistance to the wind compared to other styles of fences and therefore must have a lot of structural strength to stand up to the force of the wind.

Figure 1:
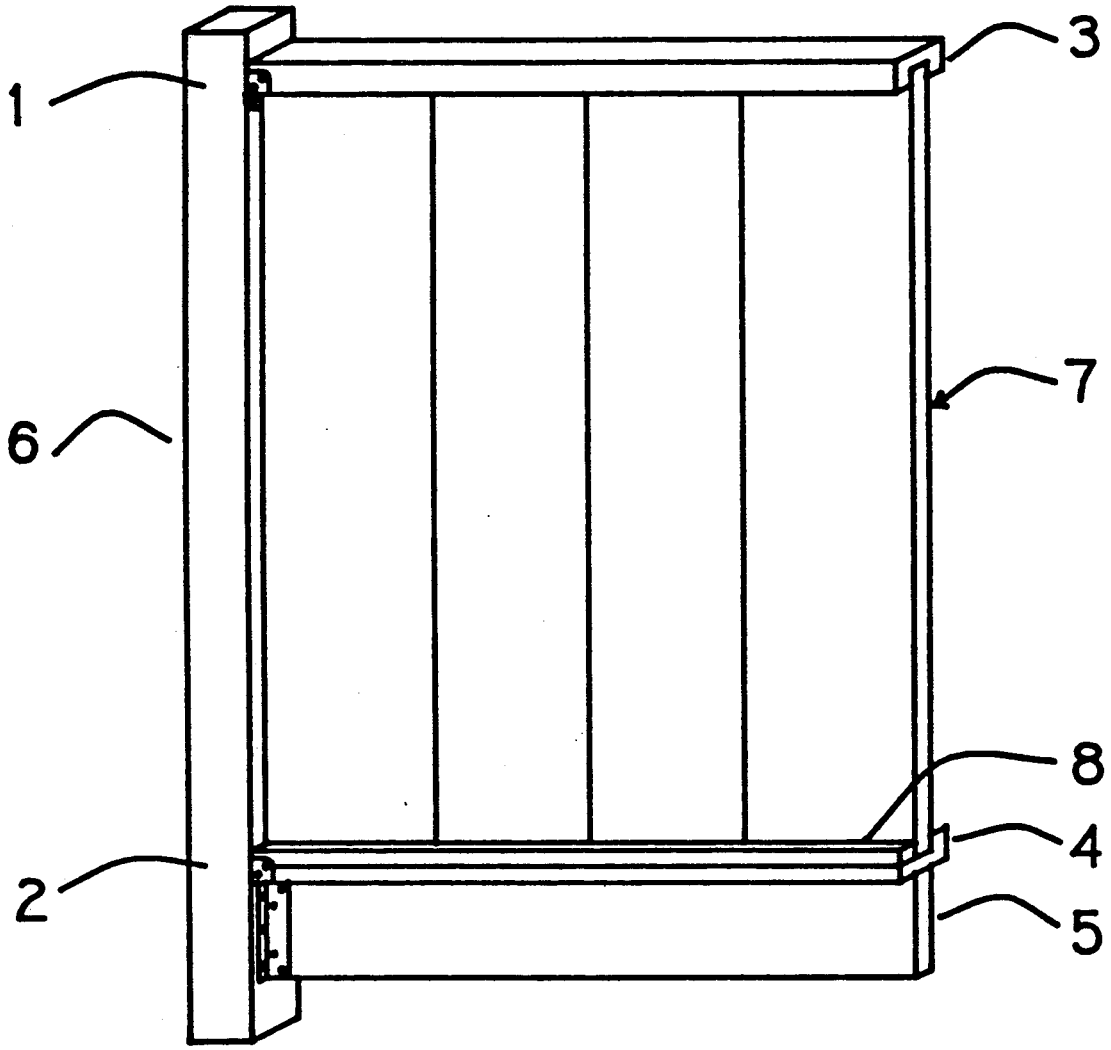
FIG. 1 shows a segment of a good neighbor fence assembled with the fence construction system.

The present invention addresses this problem directly. The system of metal brackets, (1) and (2) in FIG. 1, provides a rapid and sturdy method for attaching the upper and lower horizontal rails (3) and (4) and the kickboard (5) to the vertical posts (6) without the need for costly or time consuming assembly methods. A complete fence can be assembled quickly from precut or standard size lumber without much cutting and fitting on site.

Figure 3:
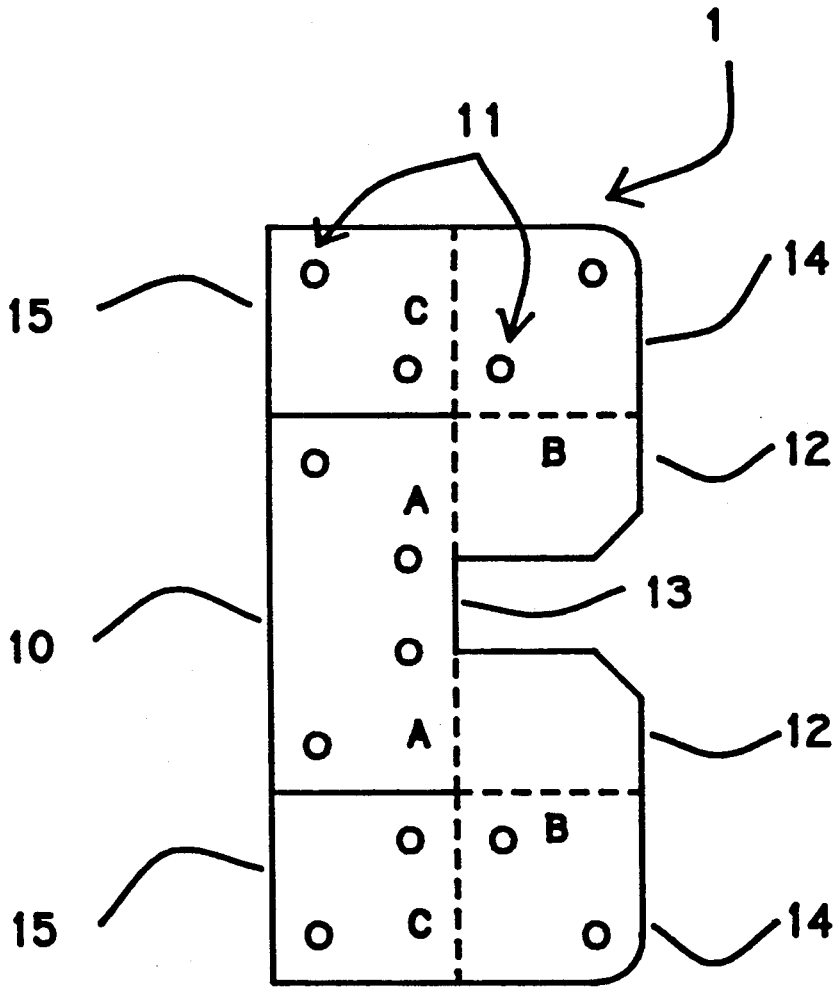
FIG. 3 shows the sheet metal pattern for the upper bracket.
Figure 4:
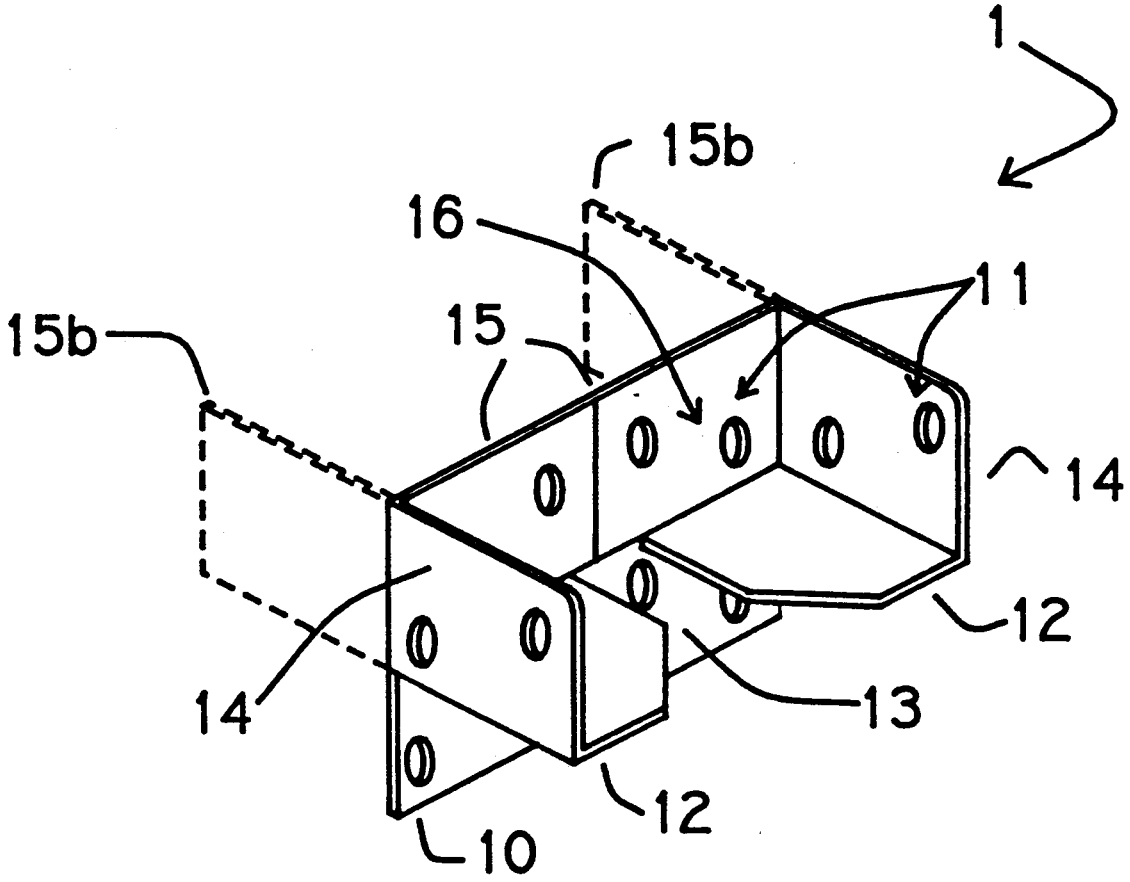
FIG. 4 shows the upper bracket of the fence construction system.

The upper bracket (1) is made from a single piece of sheet metal. FIG. 3 shows the upper bracket (1) as it is cut or punched from the flat metal sheet, while FIG. 4 shows the completed upper bracket (1). To form the upper bracket (1) the bottom flange (10) is folded downward at a right angle along the lines marked A in FIG. 3. Then, the upper reversible flanges (15) are bent upward at a right angle along lines C. The bracket is completed by bending the side flanges (14) upward at a right angle along lines B. The seats (12) together with the side flanges (14) form a shallow U-shaped upper rail support channel (16). There is a space (13) between the two seats (12) to accept the thickness of a fence board (7) so there will be no gaps in the fence. Holes (11) are provided in the bottom flange (10) and the upper reversible flanges (15) for attaching the bracket to the vertical fence post (6) as with nails or screws, and in the side flanges (14) for attachment to the upper rail (3).

Alternatively, the upper reversible flanges (15) may be left straight or straightened in the field as shown by phantom lines (15*b*) for attaching to the sides of the fence post (6) rather than to the face, if so desired. It should also be noted that the angle between the bottom flange (10) and the seats (12) may be adjusted in the field without special tools if angulation of the top rail (3) is necessary due to varying terrain along the fence line. Because of this feature, small changes in angle can be accommodated without the need to miter the upper rail and larger changes of angle can be accommodated by rough mitering without any sacrifice in the strength or aesthetics of the fence. Exact mitering would be necessary in the traditional construction to accommodate any change in angle at all.

Figure 5:
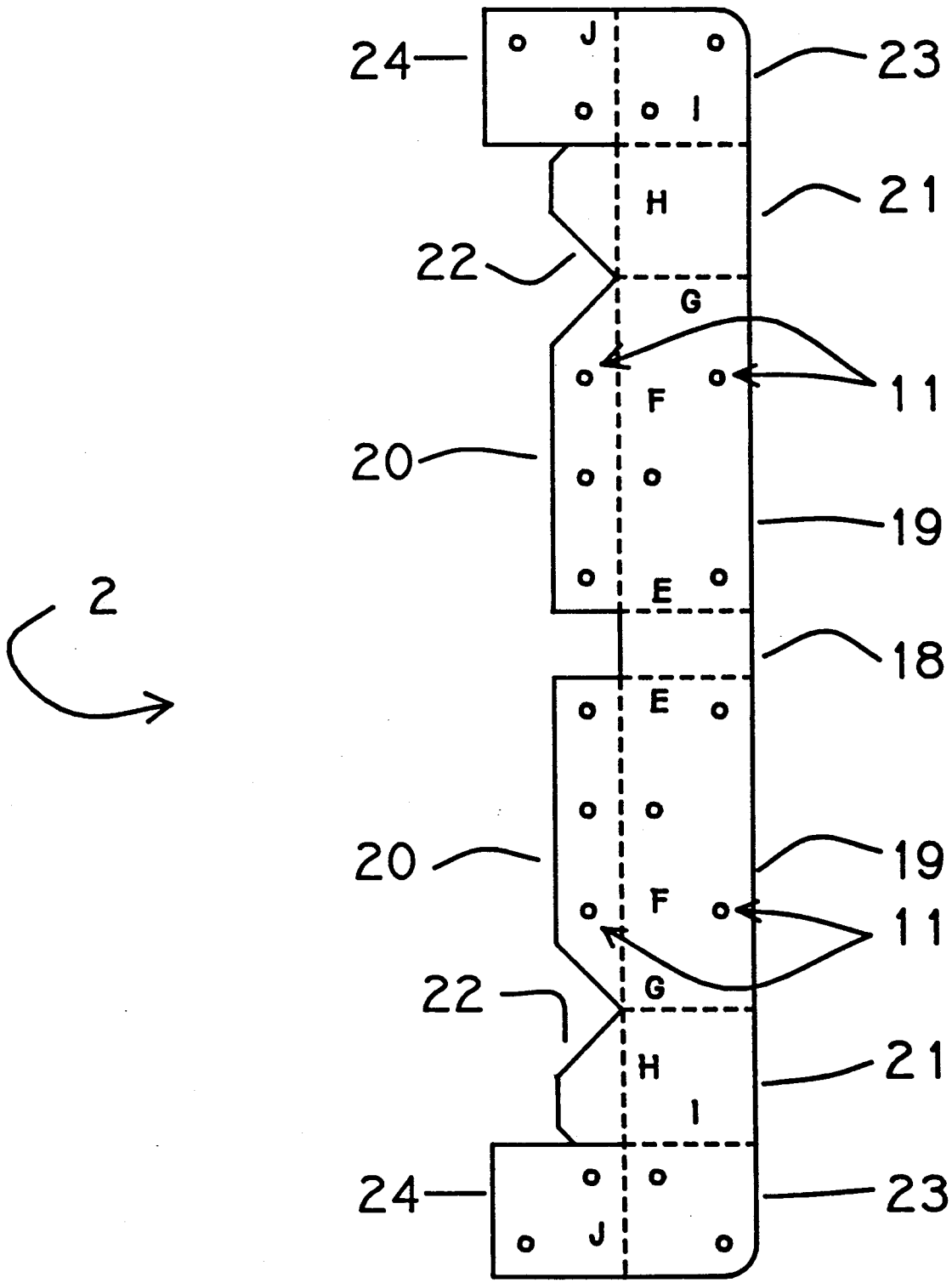
FIG. 5 shows the sheet metal pattern for the lower bracket.
Figure 6:
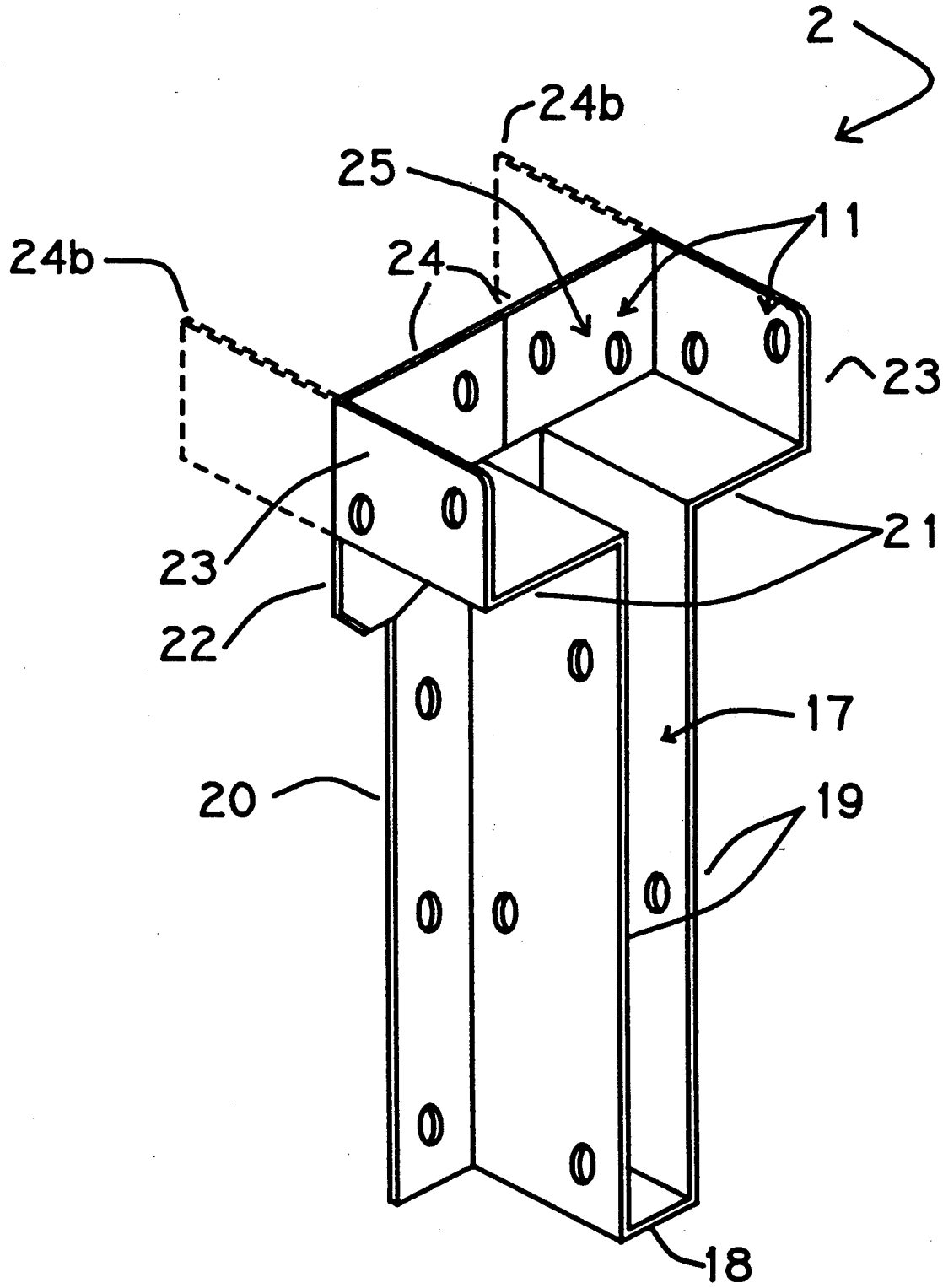
FIG. 6 shows the lower bracket of the fence construction system.

The lower bracket (2) is also made from a single piece of sheet metal. FIG. 5 shows the lower bracket (2) as it is cut or punched from the flat metal sheet and FIG. 6 shows the completed lower bracket (2). To form the lower bracket (2), the bottom side flanges (20) and the intermediate flanges (22) are folded downward at a right angle along lines F and H, respectively, and the lower reversible flanges (24) are bent upward at a right angle along lines J. Then the top side flanges (23) are bent upward at a right angle along lines I and top seats (21) are bent downward along lines G. The bracket is completed by bending the ears (19) upward at a right angle from the bottom seat (18) along lines E.

The finished lower bracket (2) assumes a T shape overall. The lower portion of the T formed by the bottom seat (18) along with the ears (19) form the U-shaped kickboard support channel (17). The upper part of the T formed by the top seats (21) along with the top side flanges (23) form the shallow U-shaped lower rail support channel (25).

Holes (11) are provided in the bottom side flanges (20), the intermediate flanges (22), and the lower reversible flanges (24) for attachment of the lower bracket (1) to the vertical fence post (6), as with nails or screws. In addition, holes (11) are provided in the ears (19) for attachment to the kickboard (5) and in the top side flanges (23) for attachment to the lower rail (4) and the nail board (8).

As with the upper bracket (1), the top reversible flanges (24) of the lower bracket (2) may be straightened as shown by the phantom lines (24*b*) for attachment to the sides of the fence post (6) if desired. The upper bracket (1) and the lower bracket (2) are made from sheet metal, preferably 18 gauge galvanized sheet steel chosen for its strength and weatherability. However, other thicknesses or materials, such as aluminum, brass, stainless steel, or wrought iron, may be chosen for their availability, visual appeal, or other properties. Other coatings, such as paint, anodizing, or plastic coating, may be used in addition to or in place of the galvanization to provide weatherability or visual appeal. Other changes may be made in the form of the brackets to enhance their visual appeal. For instance, the brackets may be formed with scalloped or scroll-shaped edges, or with a textured surface so that their presence enhances the visual appeal of the traditional fence rather than detracting from it.

Figure 7:
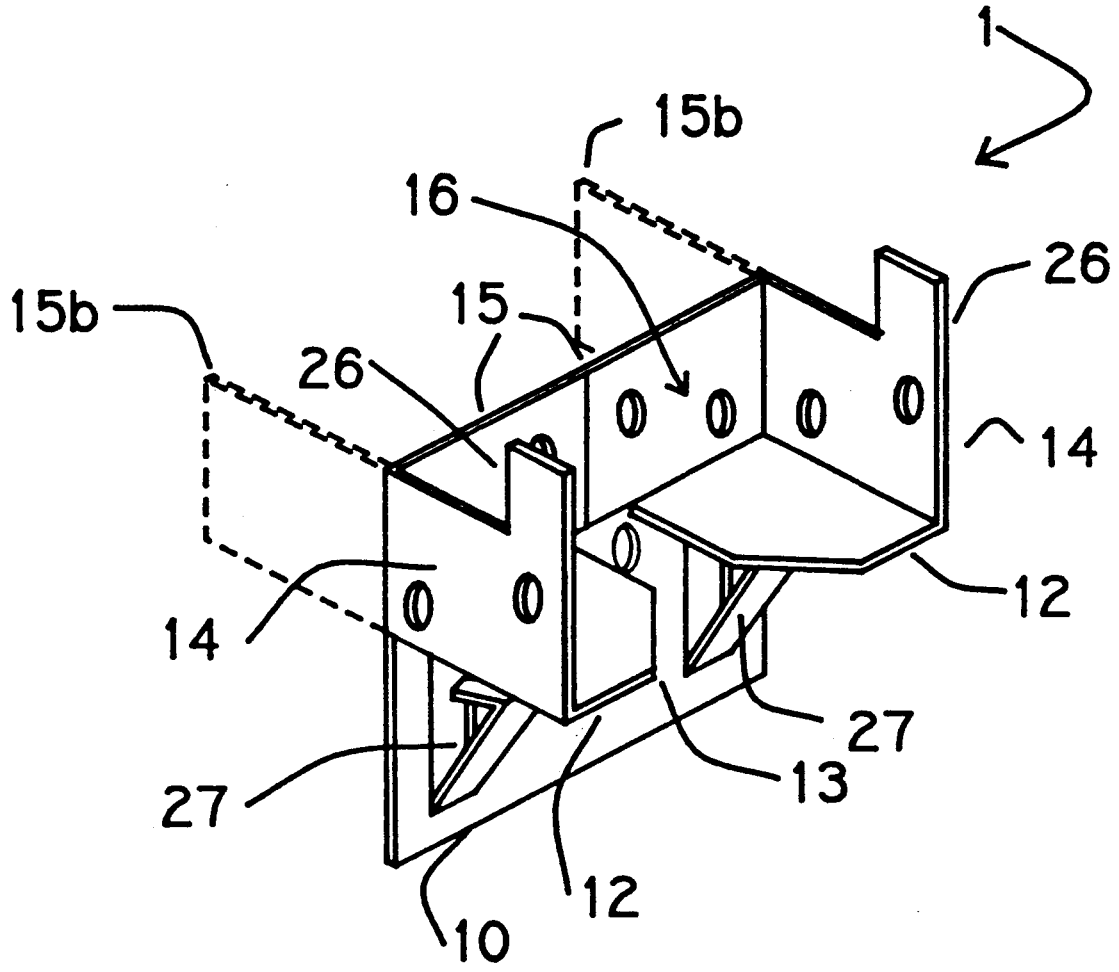
FIG. 7 shows an alternative embodiment of the upper bracket with quick attachment means.
Figure 8:
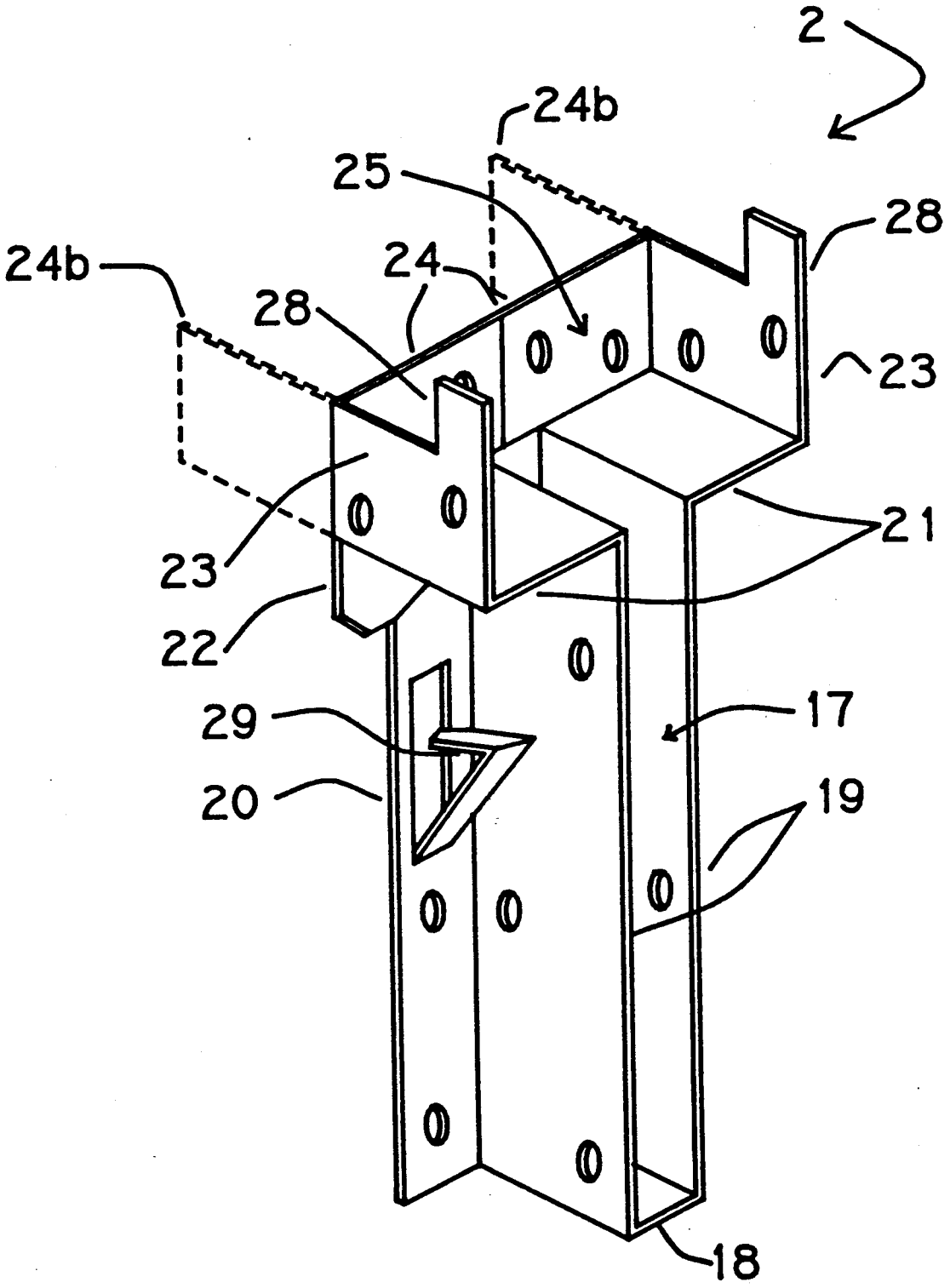
FIG. 8 shows an alternative embodiment of the lower bracket with quick attachment means.

Alternate embodiments of the upper bracket (1) and lower bracket (2) are shown in FIGS. 7 and 8. In addition to the features listed above, these alternative embodiments include one or more quick attachment means for temporarily holding the fence together until the final attachment means such as nails or screws are driven in. This feature is very convenient for holding the fence components in place during assembly, especially if the job is being done single-handedly.

Referring to FIG. 7 we see that the upper bracket (1) may include a number of tab locks (26) extending from the side flanges (14) that may be bent down with a hammer to hold the top rail (3) in place. In addition, the upper bracket (1) may also include a number of speed prongs (27) formed integrally with the bottom flange (10) or the reversible flanges (15). These speed prongs (27) are made by cutting or punching an elongated vertical U-shaped slot to make a strip that is still attached at the lower end. The strip is then bent upward at an acute angle from the flange and the end portion is bent downward at a right angle and the end is sharpened. Once the upper bracket (1) is in the correct position the speed prongs (27) may be driven like nails into the fence post (6) to hold the upper bracket (1) in place.

Analogously, the lower bracket (2) in FIG. 8 may include a number of tab locks (28) extending from the top side flanges (23) to hold the lower rail (4) and the nail board (8) in place. As well, the lower bracket (2) may include a number of speed prongs (29) formed integrally with the bottom side flanges (20) or lower reversible flanges (24) that may be driven like nails into the fence post (6) to hold the lower bracket (2) in place.

ERECTING A GOOD NEIGHBOR FENCE USING THE FENCE CONSTRUCTION SYSTEM

Please refer to FIG. 1 for an understanding of this fence assembly procedure. First, wooden fence posts (6) are erected at preselected intervals along the fence line. Whenever possible, it is most convenient to make the distance between the posts equal to the length of standard sized lumber. Next, the premade upper brackets (1) and lower brackets (2) are affixed at the appropriate height on the opposing faces of each fence post (6). A kickboard (5) is dropped on-edge into the kickboard support channel (17) and fastened. Then, the L-shaped lower rail (4) is dropped into the lower rail support channel (25) and fastened, and the upper rail (3) which is shaped like an inverted U is dropped into the upper rail support channel (16) and fastened.

One by one the precut fence boards (7), which may be plain boards, ships lap boards, or tongue-and-groove boards, are placed between the upper rail(3) and lower rail (4) until the fence is solidly filled. Then the fence is completed by dropping the nail board (8) into the lower rail support channel (25) and fastening it to lock the fence boards (7) in place.

The foregoing description should not be construed as limiting the scope of the invention but merely as illustrative of the presesently preferred embodiments. Many variations or other uses for the invention, such as the building of railings, decks, or other types of construction, may be made without departing from the spirit of the invention. Thus the scope of the invention should be determined by the following claims and not limitted by the examples given.

I claim:

1. A fence construction system comprising:

an upper bracket having a U-shaped channel for receiving the upper rail of a fence and having one or more flanges for attachment of said upper bracket to a fence post, and a T-shaped lower bracket with the lower portion of the T-shape comprising a U-shaped channel for receiving the kickboard of a fence, and the upper portion of the T-shape comprising a shallow U-shaped channel for receiving the lower rail of a fence and having one or more flanges for attachment of said lower bracket to a fence post.

2. The fence construction system of claim 1 wherein said flanges of said upper and lower brackets further comprise a plurality of holes for attachment of said brackets to a fence post as with nails or screws, and said U-shaped channels further comprise a plurality of holes for attachment of said brackets to the horizontal rails and the kickboard of a fence.

3. The fence construction system of claim 2 wherein said upper and lower brackets are made of sheet metal.

4. The fence construction system of claim 3 wherein said flanges of said upper and lower brackets further comprise a plurality of sharpened speed prongs formed integrally with said flanges for attachment of said brackets to a fence post.

5. The fence construction system of claim 3 wherein said U-shaped channels of said upper and lower brackets further comprise one or more tab locks formed integrally with said U-shaped channels which may be bent over for attachment of said brackets to the horizontal rails and the kickboard of a fence.

6. The fence construction system of claim 3 wherein said flanges of said upper and lower brackets further comprise a plurality of sharpened speed prongs formed integrally with said flanges for attachment of said brackets to a fence post and wherein said U-shaped channels of said upper and lower brackets further comprise one or more tab locks formed integrally with said U-shaped channels which may be bent over for attachment of said brackets to the horizontal rails and the kickboard of a fence.

* * * * *